US006070853A

United States Patent [19]

Stolk et al.

[11] Patent Number: 6,070,853

[45] Date of Patent: Jun. 6, 2000

[54] ARRANGEMENT FOR ADJUSTING AN ELECTROMAGNETIC VALVE ACTUATOR

[75] Inventors: Thomas Stolk, Kirchheim; Alexander von Gaisberg, Fellbach, both of Germany

[73] Assignee: DaimlerChrysler AG, Stuttgart, Germany

[21] Appl. No.: 09/092,792

[22] Filed: Jun. 5, 1998

[30] Foreign Application Priority Data

Jun. 6, 1997 [DE] Germany ..... 197 23 792

[51] Int. Cl.[7] ..... F16K 31/02

[52] U.S. Cl. ..... 251/129.18; 123/90.11

[58] Field of Search ..... 251/129.18; 123/90.11

[56] References Cited

U.S. PATENT DOCUMENTS 5,804,962 9/1998 Kather et al. ..... 251/129.18

FOREIGN PATENT DOCUMENTS 0 722 039 1/1996 European Pat. Off. .

2 543 651 10/1984 France .

295 09 992 U 10/1995 Germany .

*Primary Examiner*—Kevin Shaver

*Assistant Examiner*—David Bonderer

*Attorney, Agent, or Firm*—Klaus J. Bach

[57] ABSTRACT

In an arrangement and method for adjusting an electromatic gas change valve including: an opening and a closing magnet for operating a valve member of the gas change valve; an armature disposed between the opening and closing magnets and operative for movement with the valve member; and an upper and a lower valve spring engaging the valve member and arranged in opposition to each other under pretension so as to hold the valve member and the armature in an equilibrium position, adjustment means are provided for adjusting the equilibrium position during valve operation wherein the current consumption values of the opening and closing magnets over time are measured and integrals thereof are formed in an evaluation unit and the adjustment means are adjusted until the integrals reach a predetermined value corresponding to the desired equilibrium position.

9 Claims, 2 Drawing Sheets

ARRANGEMENT FOR ADJUSTING AN ELECTROMAGNETIC VALVE ACTUATOR

BACKGROUND OF THE INVENTION

The invention relates to an arrangement for adjusting an electromagnetic actuator for a gas exchange valve, which includes valve opening and valve closing magnets between which an armature is movably disposed and held by upper and lower pretensioned valve springs, when the magnets are de-energized, in a rest position which is adjustable depending on sensor values of the magnets.

Electromagnetic actuators for the actuation of gas change valves (intake and exhaust valves) include generally two operating magnets, an opening magnet and a closing magnet with spaced pole faces, between which an armature is disposed movably with respect to the axis of the gas change valve. The armature acts on the valve shaft of the gas change valve either directly or by way of an armature bolt. In actuators operating in accordance with the principle of a mass oscillator, a pretensioned spring mechanism acts on the armature. Generally two pretensioned valve springs are used, that is, an upper and a lower valve spring. The upper valve spring applies a force to the gas change valve in an opening direction and the lower valve spring applies a force to the gas change valve in a valve closing direction.

When the magnets are de-energized, the armature is held by the springs in an equilibrium position between the magnets which, for best operation, is usually the center position between the pole surfaces of the magnets.

When, upon start-up, the actuator is operated, either the closing magnet or the opening magnet is shortly over-energized in order to pull the armature out of the equilibrium position, or an impulse application procedure is performed by which the magnets are alternately energized whereby the armature is oscillated until the armature can be caught by one of the magnets. When the gas change valve is closed, the armature is in contact with the pole surface of the energized closing magnet and is retained thereby. The closing magnet further pretensions the valve spring, which is effective in opening direction. To open the gas change valve, the closing magnet is de-energized and the opening magnet is energized. The valve spring acting in opening direction accelerates the armature beyond the equilibrium position so that it is attracted by the opening magnet. The armature is decelerated by the valve spring acting in the closing direction and hits the pole surface of the opening magnet by which it is held in an open valve position. To again close the gas change valve, the opening magnet is de-energized and the closing magnet is energized. The closing process corresponds to the opening process.

Certain values which are not originally taken into consideration or which change over time, such as manufacturing tolerances of the various components, heat expansion of different materials, different spring constants of the upper and the lower valve spring as well as settling of springs by aging could have the result that the equilibrium position determined by the valve springs does not coincide with the geometric center position between the pole surfaces or that it is not at a predetermined distance therefrom.

The energy required by the closing magnet and the opening magnet, called the catch energy, for attracting the armature from a predetermined distance increases exponentially with the distance. As a result, an armature which, in the rest position, is displaced from the center position for example in the direction toward the opening magnet, causes the energy requirement for the opening magnet to be reduced. At the same time, the energy requirements for the closing magnet are increased exponentially with the increased distance of the armature from the closing magnet that is at a substantially greater amount of energy is required for operating the opening magnet than for the closing magnet. As a result, the total energy requirement increases. The optimal equilibrium position of the armature determined by the valve spring is therefore the center position between the pole faces.

Furthermore, because of the exponential relationship, distances are rapidly reached for which the energy requirements are unacceptably high so that the opening or, respectively, closing magnet can no longer attract the armature. In this case, the actuator becomes inoperative.

DE 39 20 976 A1 discloses an electromagnetic control valve for displacement machines. It includes an armature which is held by at least two springs between an opening magnet and a closing magnet and operates in accordance with the principle of a spring-supported mass oscillator. For closing the control valve, the armature which acts on the shaft of the control valve is attracted by the closing magnet while pretensioning an opening spring. When the control valve opens, the closing magnet is de-energized and the opening spring, in cooperation with the energized opening magnet, moves the control valve to an open position.

By means of a control screw the equilibrium position of the oscillation system comprising the springs, the armature, the shaft of the control valve to be operated and a spring plate is so adjusted that the armature is disposed in the center between the closing and opening magnets when the magnets are de-energized. The center position, however, can be adjusted only when the valve is not in operation. Changes which may occur during operation of the valve, for example, because of different temperatures and heat expansion as well as by wear are not taken into account. In addition, it is difficult to determine accurately the center position during the adjustment.

DE 196 31 909 A1 discloses a method for the adjustment of the rest position of an armature of an electromagnetic actuator as it is used for example in piston type internal combustion engines for the operation of gas change valves. The rest position corresponds to an equilibrium position which is determined by the pretension of the valve springs while the magnets are de-energized. In this method, the inductivity of the two electromagnets is measured and, from a comparison of the two measured inductivity values, the location of the armature in the equilibrium position with respect to the pole faces of the electromagnets is derived. During measurement, the armature is in the equilibrium position. However it is also possible to measure the inductivity of the respective electromagnet, when it is engaged by the armature and to compare the measured valve and/or the difference between the two measured valves with a predetermined value and to derive, in this way, a correction value for a control signal. During measurement, the armature can be held in engagement with the respective electromagnet by mechanical means or by a holding current. Consequently, the method is not suitable to correct the center position or, respectively, the equilibrium position of the armature during operation of the system.

It is the object of the present invention to provide an arrangement and a method for adjusting the center position of an armature of an electromagnetic valve actuator during valve operation.

SUMMARY OF THE INVENTION

In an arrangement and method for adjusting an electromatic gas change valve including an opening and a closing magnet for operating a valve member of the gas charge valve, an armature disposed between the opening and closing magnets and operative for movement with the valve member, and an upper and a lower valve spring engaging the valve member and arranged in opposition to each other under pretension so as to hold the valve member and the armature in an equilibrium position, adjustment means are provided for adjusting the equilibrium position during valve operation wherein the current consumption values of the opening and closing magnets over time are measured and integrals thereof are formed in an evaluation unit and the adjustment means are adjusted until the integrals reach a predetermined value corresponding to the desired equilibrium position.

The adjustment means are preferably expansion material elements including, solid materials with high heat expansion coefficients. Alternately, liquids or wax-like materials disposed in a closed longitudinally expandable housing may be used. Such expansion material elements have suitably an annular shape and are arranged coaxially with the valve springs. Instead of expansion elements, bi-metallic elements may be provided which change their length when heated.

The expansion material elements as well as the bi-metal elements may be heated for example by an electric resistor or in an inductive manner. They are heated until the armature reaches the desired equilibrium position.

With a piston internal combustion engine including an electronic engine control the electronic engine control is preferably also used as an evaluation unit which can evaluate the parameters needed for the adjustment with little expenses.

With the method according to the invention, the current consumption of the magnets during energization is measured and, in an electronic evaluations unit, a performance value for the equilibrium position of the armature is formed from a comparison of the current over time curve for the closing and the opening stroke of the valve. The performance value is compared with a desired value wherein, dependent on the deviation, the equilibrium position of the armature is changed by adjustment means in the direction toward the desired value. Preferably, area integrals are formed from the current over time curves which are compared with one another. Since it is advantageous that, when the armature is disposed in its equilibrium position, it is also in a center position between the magnets. The pre-tensioning of the valve springs can be changed by the adjustment means until the area integrals have the same value. If the equilibrium position is to be different from the center position of the armature, predetermined desired differences in the area integrals may be provided.

The current over time curves are recorded and evaluated during operation so that the equilibrium position of the armature can be adapted by the adjustment means to the desired value during operation of the valve. As a result, changes caused by temperature variations, wear etc., can be accommodated.

Further details of the invention as well as the advantages derived therefrom will be apparent from the following description of an embodiment of the invention.

DESCRIPTION OF PREFERRED EMBODIMENTS

Figure 1:
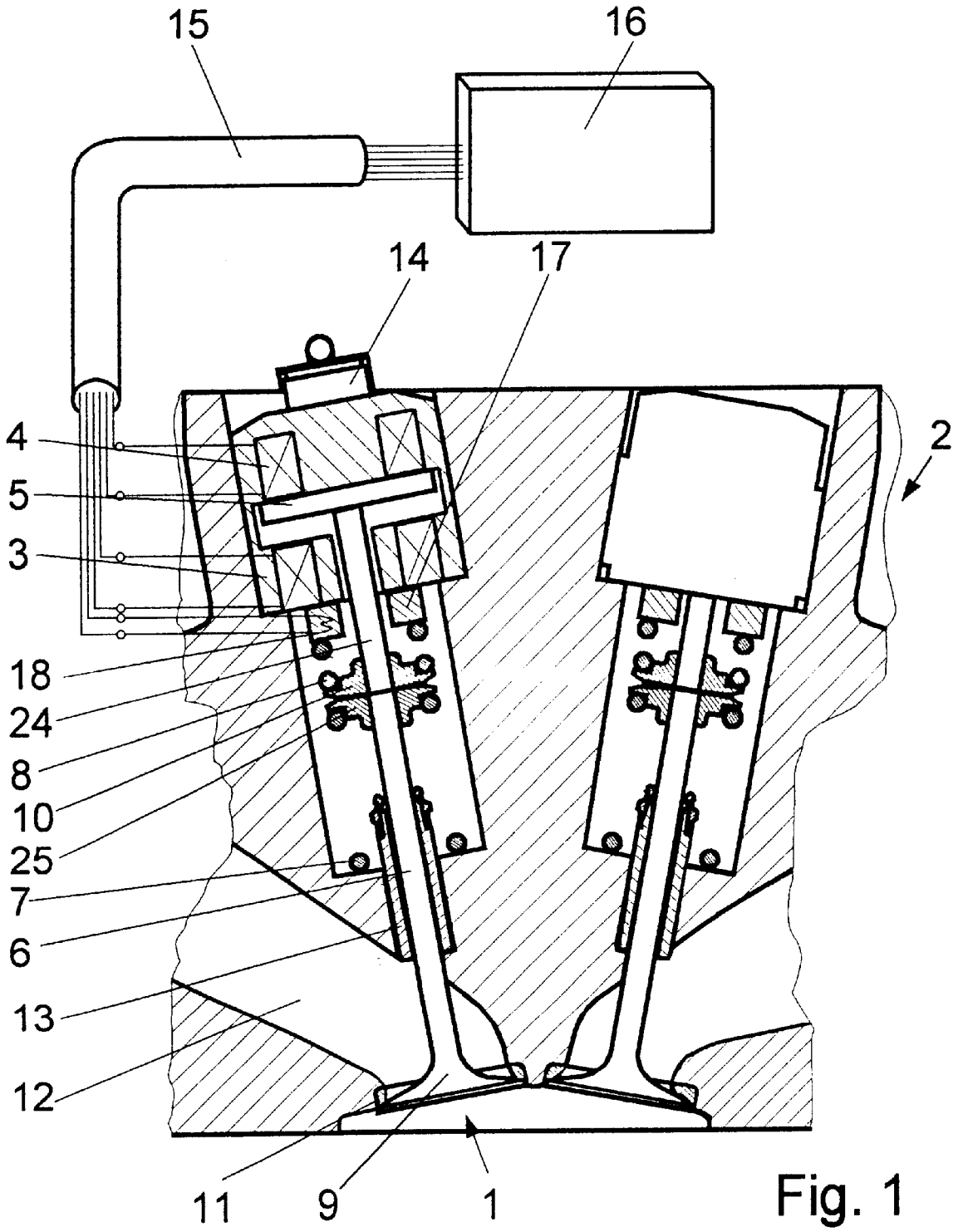
FIG. 1 is a partial cross-sectional view of a cylinder head of a piston type internal combustion engine with electromagnetically operated gas change valves.

FIG. 1 shows an electromagnetic actuator for operating a gas change valve 1 which actuator is disposed in a cylinder head 2. The actuator includes an opening magnet 3 and a closing magnet 4, which are firmly connected to each other.

An armature 5 is arranged between the magnets 3, 4 so as to be movable coaxially with a valve shaft 6. The armature 5 is guided in the opening magnet 3 and acts by way of an armature rod 24 on the valve shaft 6 of the gas change valve 1 which is guided in a valve guide 13. The valve shaft 6 can be formed integrally with the armature rod 24. The armature 5 is engaged by an upper and a lower pretensioned valve spring 8, 7, which are both arranged at the side of the opening magnet 3 adjacent the gas change valve 1. The lower valve spring 7 is disposed between the cylinder head 2 and a spring plate 25, which is firmly attached to the valve shaft 6. The upper valve spring 8 is engaged between another spring plate 10, which is firmly attached to the armature rod 24 and is supported at the other end by adjustment means 17 on the opening magnet 3.

When the magnets 3, 4 are not energized, the armature 5 is held by the valve springs 7, 8 in an equilibrium position between the magnets 3, 4. When, upon start up, the actuator is operated, the closing magnet 4 is shortly over-energized or the armature 5 is oscillated by a start up routine in order to move it out of the equilibrium position and facilitate attraction by the closing or opening magnet.

When the gas exchange valve 1 is closed, its valve plate 9 is disposed on a valve seat ring 11 and, as a result, closes a gas flow opening between a combustion chamber and a gas flow passage 12. At the same time, the armature 5 is attracted by the energized closing magnet 4 and is retained thereby. The closing magnet 4 compresses the upper valve spring 8 which acts in valve opening direction. In order to open the gas change valve 1, the closing magnet 4 is de-energized and the opening magnet 3 is energized. The upper pretensioned valve spring 8 which acts in opening direction accelerates the armature 5 beyond the equilibrium position and the armature 5 is attracted by the opening magnet 3. Upon opening the valve 9, the armature engages the pole surface of the opening magnet while at the same time compressing the closing spring 7. The armature is held in a valve opening position by the opening magnet 3.

Figure 2:
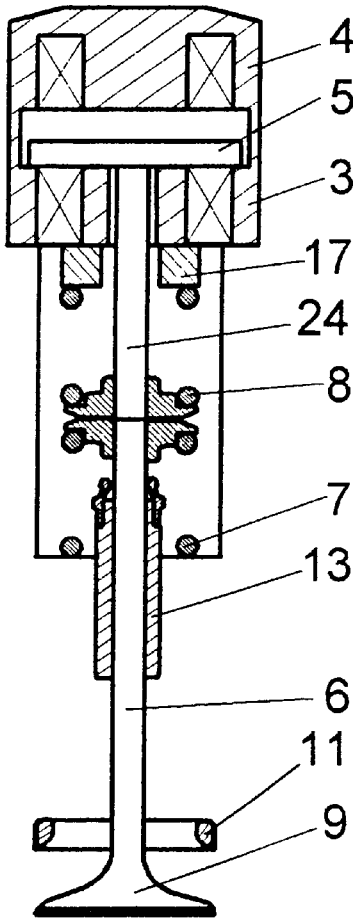
FIG. 2 shows a gas change valve with an actuator in an open position.
Figure 4:
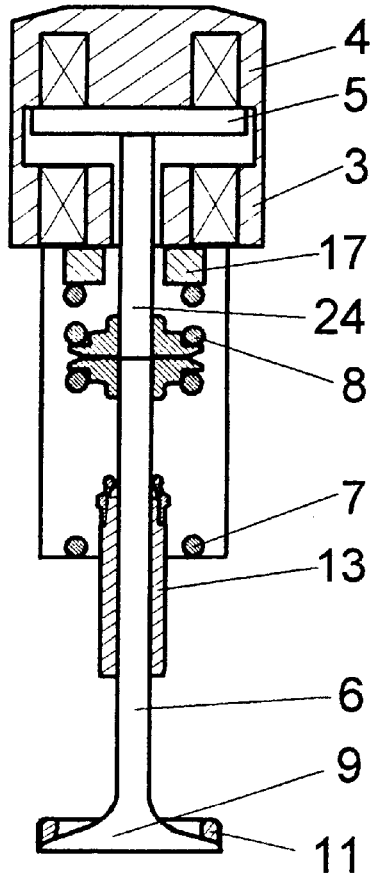
FIG. 4 shows a gas change valve with an actuator in a closed position.
Figure 3:
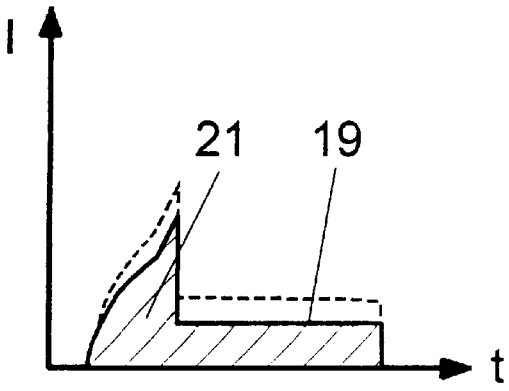
FIG. 3 shows a current consumption curve over time for a valve stroke to an open position as shown in FIG. 2.
Figure 5:
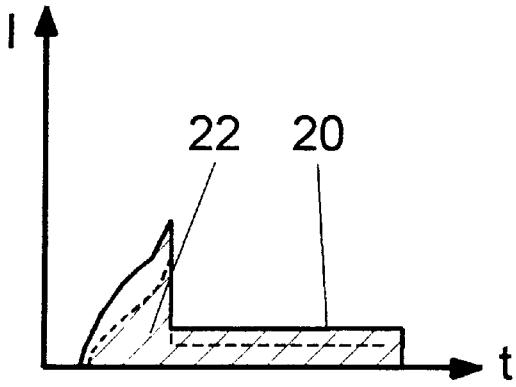
FIG. 5 shows a current consumption curve over time for the closing phase of a gas valve as shown in FIG. 4.

In accordance with the invention, an evaluation unit 16 such as the engine electronic control unit records the current over time value of the opening magnet 3 during the opening phase of the gas change valve 1 and, respectively, the current over time value of the closing magnet 4 during the closing phase of the gas change valve 1. The current value I over time t is shown in FIG. 3 for the opening magnet 3 and is indicated by the numeral 19, whereas the current value I over time t for the closing magnet 4 is shown in FIG. 5 and indicated by the numeral 20. The hatched surface areas below the current curves 19, 20 indicate the respective area integrals 21 for the opening magnet 3 and 22 for the closing magnet 4. FIG. 2 shows the position of the open gas change valve 1 corresponding to the current over time curve 19 of FIG. 3. FIG. 4 shows the position of the closed gas change valve 1 corresponding to the current over time curve 20 of FIG. 5.

When the armature 5 is in the equilibrium position in a center position between the pole faces of the opening magnet 3 and the closing magnet 4, the area integrals 21 and 22 are the same. If however, the equilibrium position differs from the center position, a current over time curve will be established for example as it is shown in FIGS. 3 and 5 by the dashed lines. The area integrals of the dashed lines are not equal. By adjustment means 17 for example in the form of an electrically heatable expansion material element the equilibrium position can be corrected so that the area integrals 21 and 22 of the current over time curves 19 and 20 have again the same value. As electrical heater for example an electric resistor in the form of a heating coil 18 is used.

If the equilibrium position of the armature 5 is intended to be off the center position by a predetermined value the adjustment means 17 can be so controlled that a predetermined difference of the surface integrals 21, 22 is obtained. The magnets 3, 4 and also the adjustment means 17 are connected to the evaluation unit 16 by way of control lines 15.

What is claimed is:

1. An arrangement for adjusting an electromagnetic valve actuator for operating a gas change valve including an opening magnet and a closing magnet arranged in spaced relationship from said opening magnet and along a single axis, an armature disposed between said opening and closing magnets so as to be movable along the axis of, and between, said magnets, a valve mounted for movement with said armature, an upper and a lower valve spring arranged in opposition to each other and engaging said valve under pretension so as to hold said valve and said armature in an equilibrium position between said opening and closing magnets, and adjustment means for adjusting the equilibrium position of said armature between said opening and closing magnets comprising at least one electrically heatable expansion element on which at least one of said upper and lower valve springs is supported.

2. An arrangement according to claim 1, wherein said heatable expansion element is an annularly shaped expansion material element arranged coaxially with said valve springs.

3. An arrangement according to claim 1, wherein said heatable expansion element is an annularly shaped bi-metal element.

4. An arrangement according to claim 1, wherein said adjustment means includes an evaluation unit for evaluating the signals representative of the equilibrium position of said valve and armature during valve operation and for causing said adjustment means to adjust said equilibrium position to a desired position.

5. An arrangement according to claim 4, wherein said evaluation unit is part of an engine control unit.

6. A method of adjusting an electromagnetic valve actuator for operating a gas change valve including an opening magnet and a closing magnet arranged in spaced relationship from said opening magnet and along a single axis; an armature disposed between said opening and closing magnets so as to be movable along said axis and between said magnets; a valve mounted for movement with said armature between a valve opening and a valve closing position; an upper and a lower valve spring arranged in opposition to each other and engaging said valve under pretension so as to hold said valve and said armature in an equilibrium position when said magnets are de-energized; and adjustment means for adjusting said equilibrium position; said method comprising the steps of measuring, during energization of said opening and closing magnets, the current consumption of said opening and closing magnets over time for the valve closing stroke and for the valve opening stroke; comparing the measured values in an electronic evaluation unit; and providing a performance value indicating the equilibrium position of said valve and armature.

7. A method according to claim 6, wherein in said evaluation unit, the area integrals of the current over time curve for the current consumption of said opening and closing magnets during the valve opening and the valve closing procedure are formed and the values are compared with each other.

8. A method according to claim 7, wherein said adjustment means are adjusted during valve operation until the area integrals found and compared in the evaluation unit have reached a predetermined value.

9. A method according to claim 8, wherein said adjustment means are adjusted until the area integrals have the same value.

* * * * *